US009696667B2

(12) United States Patent
Tanaka

(10) Patent No.: US 9,696,667 B2
(45) Date of Patent: Jul. 4, 2017

(54) CONSTRAINING MECHANISM, CLEANING DEVICE, IMAGE CARRIER UNIT, AND IMAGE FORMING APPARATUS

(71) Applicant: FUJI XEROX CO., LTD., Tokyo (JP)

(72) Inventor: Daisuke Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/614,833

(22) Filed: Feb. 5, 2015

(65) Prior Publication Data

US 2015/0241836 A1 Aug. 27, 2015

(30) Foreign Application Priority Data

Feb. 27, 2014 (JP) ..... 2014-037131

(51) Int. Cl.
*G03G 15/16* (2006.01)

(52) U.S. Cl.
CPC ..... *G03G 15/168* (2013.01)

(58) Field of Classification Search
CPC ..... G03G 21/0011; G03G 15/168
USPC ..... 399/102, 105, 123, 101
See application file for complete search history.

(56) References Cited

U.S. PATENT DOCUMENTS 5,404,216 A * 4/1995 Numagami ..... G03G 21/0029 399/102
5,455,665 A * 10/1995 Baba ..... G03G 21/0011 15/256.5
5,774,765 A * 6/1998 Hirota ..... G03G 21/0011 399/102
6,496,668 B2 * 12/2002 Sato ..... G03G 15/0898 399/105
7,215,902 B2 * 5/2007 Ishii ..... G03G 15/0817 399/105
8,369,737 B2 * 2/2013 Sakamoto ..... G03G 15/0898 399/105
2012/0114403 A1 * 5/2012 Takenouchi ..... G03G 15/161 399/350
2012/0269538 A1 * 10/2012 Matsushita ..... G03G 15/0817 399/105
2014/0072326 A1 * 3/2014 Yamaguchi ..... G03G 21/0011 399/102

FOREIGN PATENT DOCUMENTS

JP H11-116782 A 4/1999
JP 2002-086553 A 3/2002
(Continued)

OTHER PUBLICATIONS

Nov. 15, 2016 Office Action issued in Japanese Application No. 2014-267004.
(Continued)

*Primary Examiner* — Susan Lee
(74) *Attorney, Agent, or Firm* — Oliff PLC

(57) ABSTRACT

A constraining mechanism includes a porous member that is in contact with a rotating body, which rotates about a rotation axis, and restrains foreign objects from moving in an axial direction of the rotating body and a covering portion that covers a portion of the porous member including an end portion of the porous member located upstream in a direction of rotation of the rotating body and that is in contact with the rotating body as a result of being pressed by the porous member.

14 Claims, 5 Drawing Sheets

(56) References Cited

FOREIGN PATENT DOCUMENTS

| | | | |
|---|---|---|---|
| JP | 2002-341650 | A | 11/2002 |
| JP | 2008-299064 | A | 12/2008 |
| JP | 2012-077241 | A | 4/2012 |
| WO | 2013/111846 | A1 | 8/2013 |

OTHER PUBLICATIONS

Mar. 21, 2017 Office Action issued in Japanese Patent Application No. 2014-037131.

* cited by examiner

CONSTRAINING MECHANISM, CLEANING DEVICE, IMAGE CARRIER UNIT, AND IMAGE FORMING APPARATUS

CROSS-REFERENCE TO RELATED APPLICATIONS

This application is based on and claims priority under 35 USC 119 from Japanese Patent Application No. 2014-037131 filed Feb. 27, 2014.

BACKGROUND

Technical Field

The present invention relates to a constraining mechanism, a cleaning device, an image carrier unit, and an image forming apparatus.

SUMMARY

According to an aspect of the invention, there is provided a constraining mechanism including a porous member that is in contact with a rotating body, which rotates about a rotation axis, and restrains foreign objects from moving in an axial direction of the rotating body and a covering portion that covers a portion of the porous member including an end portion of the porous member located upstream in a direction of rotation of the rotating body and that is in contact with the rotating body as a result of being pressed by the porous member.

BRIEF DESCRIPTION OF THE DRAWINGS

An exemplary embodiment of the present invention will be described in detail based on the following figures, wherein.

DETAILED DESCRIPTION

Figure 1:
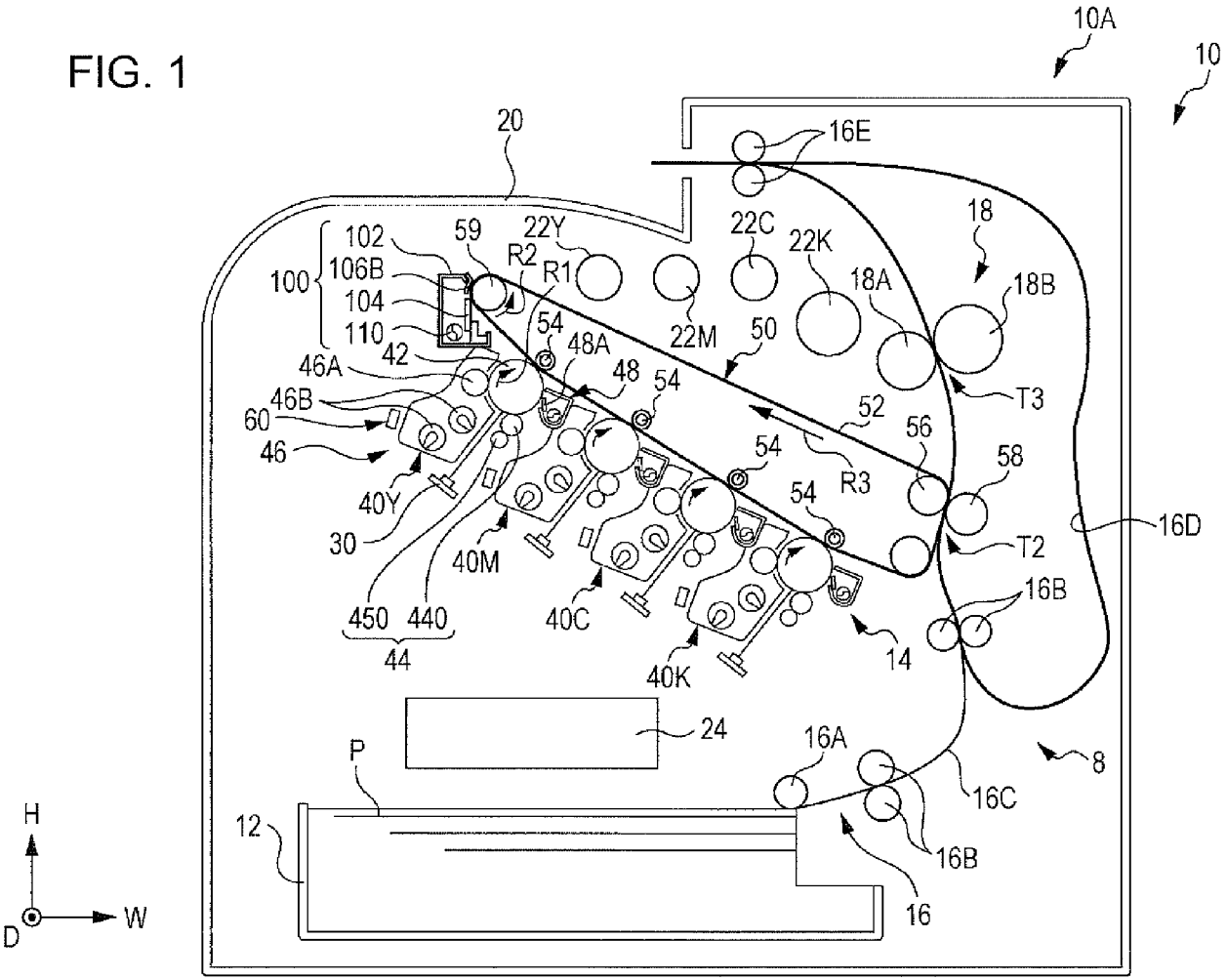
FIG. 1 is a schematic diagram (front view) of an image forming apparatus of the exemplary embodiment.

An exemplary embodiment will be described with reference to the drawings. First, the overall configuration and operation of an image forming apparatus will be described. Next, a principal portion (a transfer device) of the present exemplary embodiment will be described. Note that a direction that is indicated by arrow H illustrated in FIGS. 1 to 5 is a height direction of the image forming apparatus (hereinafter referred to as apparatus height direction), and a direction that is indicated by arrow W illustrated in FIGS. 1 to 5 is a width direction of the image forming apparatus (hereinafter referred to as apparatus width direction). In addition, a direction (suitably indicated by arrow D) perpendicular to the apparatus height direction and the apparatus width direction is a depth direction of the image forming apparatus (hereinafter referred to as apparatus depth direction).

<Overall Configuration of Image Forming Apparatus>

<<Overall Configuration>>

An image forming apparatus 10 includes an image forming unit 8, and a controller 24. The overall configuration of the image forming apparatus 10 will be described below with reference to FIG. 1.

The image forming unit 8 includes a medium-accommodating section 12, a toner-image-forming section 14, a transport section 16, a fixing device 18, an ejecting section 20, and supply mechanisms 22Y, 22M, 22C, and 22K. The image forming unit 8 is configured to form an image on a medium P. The controller 24 is configured to control the operation of each section of the image forming apparatus 10.

<<Image Forming Unit>>

[Toner-Image-Forming Section]

The toner-image-forming section 14 includes image forming units 40Y, 40M, 40C, and 40K and a transfer unit 50. Here, yellow (Y), magenta (M), cyan (C), and black (K) are examples of toner colors. The transfer unit 50 is an example of an image carrier unit.

The configurations of the image forming units 40Y, 40M, 40C, and 40K are substantially similar to one another except for toners to be used in the image forming units 40Y, 40M, 40C and 40K. Accordingly, the reference numerals of portions that form the image forming units 40M, 40C, and 40K are omitted in FIG. 1.

<Image Forming Unit>

The image forming unit 40Y includes a photoconductor drum 42Y, a charging device 44Y, an exposure device 30Y, a developing device 46Y, and a removal device 48Y. Similarly, the image forming unit 40M includes a photoconductor drum 42M, a charging device 44M, an exposure device 30M, a developing device 46M, and a removal device 48M. The image forming unit 40C includes a photoconductor drum 42C, a charging device 44C, an exposure device 30C, a developing device 46C, and a removal device 48C. The image forming unit 40K includes a photoconductor drum 42K, a charging device 44K, an exposure device 30K, a developing device 46K, and a removal device 48K. In the following description, the suffixes Y, M, C, and K are omitted when it is not necessary to distinguish the image forming units 40Y, 40M, 40C, and 40K and the members that form the image forming units 40Y, 40M, 40C, and 40K in accordance with the toner colors (Y, M, C, and K).

In the image forming units 40Y, 40M, 40C, and 40K, toner images of yellow (Y), magenta (M), cyan (C), and black (K) are to be formed on outer circumferential surfaces of the corresponding photoconductor drums 42Y, 42M, 42C, and 42K. The image forming units 40Y, 40M, 40C, and 40K are arranged in such a manner that the image forming units 40 are inclined in the apparatus width direction when seen as a whole (see FIG. 1).

(Photoconductor Drum)

Each of the photoconductor drums 42 has a function of holding a toner image that is developed by a corresponding one of the developing devices 46. Each of the photoconductor drums 42 is formed in a cylindrical shape and configured to be driven by a driving unit (not illustrated) so as to rotate about its own axis in the direction of arrow R1 (see FIG. 1). Each of the photoconductor drums 42 includes an aluminum base member and a photosensitive layer (not illustrated) that is formed by forming an undercoat layer, a charge generating layer, and a charge transport layer on the base member in this order. Each of the photoconductor drums 42 is an example of an image carrier.

(Charging Device)

Each of the charging devices 44 has a function of charging the outer circumferential surface of a corresponding one of the photoconductor drums 42. Each of the charging devices 44 is disposed along the direction (apparatus depth direction) of the corresponding photoconductor drum 42 axis. Each of the charging devices 44 includes a charging roller 440 and a cleaning roller 450. Voltages required for charging the outer circumferential surfaces of the photoconductor drums 42 are to be applied to shafts (not illustrated) of the charging rollers 440. As a result, the charging rollers 440 charge the outer circumferential surfaces of the corresponding photoconductor drums 42 so as to cause the outer circumferential surfaces to have a negative polarity. The cleaning rollers 450 are configured to remove impurities, such as toners, additives, paper dust, and dust, which are deposited on the outer circumferential surfaces of the corresponding charging rollers 440.

<Exposure Device>

Each of the exposure devices 30 has a function of forming a latent image on the outer circumferential surface of a corresponding one of the photoconductor drums 42, which has been charged by the corresponding charging device 44. The exposure devices 30 are configured to emit exposure light beams from light-emitting diode arrays (not illustrated) in accordance with image data items received from an image-signal-processing section (not illustrated) that is included in the controller 24. The exposure light beams are adjusted to irradiate the outer circumferential surfaces of the corresponding photoconductor drums 42, which have been charged by the corresponding charging devices 44, in such a manner as to form latent images on the outer circumferential surfaces.

(Developing Device)

Each of the developing devices 46 has a function of developing a latent image formed on a corresponding one of the photoconductor drums 42 into a toner image. Each of the developing devices 46 is disposed along the direction of the corresponding photoconductor drum 42 axis. Each of the developing devices 46 includes a toner-supply member 46A that supplies a toner to the outer circumferential surface of the corresponding photoconductor drum 42, plural transport members 46B that transport a developer, which contains a toner and a carrier, to the toner-supply member 46A, and a toner-density sensor 60 that detects the toner density in the developing device 46.

Each of the toner-density sensors 60 is configured to detect the permeability of the developer in the corresponding developing device 46 on the basis of the permeability of the developer containing the toner and the carrier varying in accordance with the toner density and to calculate the toner density on the basis of detection results.

(Removal Device)

The removal devices 48 have a function of removing, from the outer circumferential surfaces of the corresponding photoconductor drums 42, toners, additives, and the like (hereinafter referred to as foreign objects) that have not been transferred in a first transfer process and that remain on the outer circumferential surfaces after toner images formed on the outer circumferential surfaces of the photoconductor drums 42 have been transferred in the first transfer process to a transfer belt 52. Each of the removal devices 48 is disposed along the direction of the corresponding photoconductor drum 42 axis and includes a blade 48A that makes contact with the outer circumferential surface of the corresponding photoconductor drum 42.

(Transfer Unit)

The transfer unit 50 has a function of transferring the toner images of the different colors, which have been developed on the outer circumferential surfaces of the photoconductor drums 42 by the developing devices 46, onto the medium P in a second transfer process after the toner images have been transferred in the first transfer process to the transfer belt 52. The transfer unit 50 includes the transfer belt 52, plural (four) first transfer rollers 54, a driving roller 56, and a second transfer roller 58. Here, the transfer belt 52 is an example of a rotating body, a transfer body, and an image carrier.

(Transfer Belt)

The transfer belt 52 is an endless belt. The plural (four) first transfer rollers 54 and the driving roller 56 are disposed in such a manner as to be in contact with the inner surface of the transfer belt 52. The arrangement of the transfer belt 52 is fixed by the plural (four) first transfer rollers 54, the driving roller 56, a tension-applying roller 59, and the like, which are in contact with the inner surface of the transfer belt 52, and the transfer belt 52 is inclined in the apparatus width direction as seen from the front. The outer circumferential surfaces of the photoconductor drums 42, which are included in the corresponding image forming units 40 that are arranged side-by-side in such a manner as to be inclined in the apparatus width direction, are in contact with a portion of the outer surface of the transfer belt 52 that faces downward in the apparatus height direction. Note that the tension-applying roller 59 that is pressed by a pressing unit (not illustrated) exerts a tension on the transfer belt 52.

(Driving Roller)

The driving roller 56 is a roller having an elongated shape. A portion of the inner surface of the transfer belt 52 is wound around a portion of the outer circumferential surface of the driving roller 56. When the driving roller 56 is caused to rotate about its own axis by a driving source (not illustrated), that is, when the driving roller 56 is caused to rotate about its own axis in the direction of arrow R2 illustrated in FIG. 1 and FIG. 3, the driving roller 56 applies a frictional force to the portion of the transfer belt 52, which is wound around the outer circumferential surface of the driving roller 56. Then, the driving roller 56 causes the transfer belt 52 to rotate in the direction of arrow R3. The driving roller 56 has a function of causing the transfer belt 52 to rotate as described above and, as will be described later, a function of serving as a backup roller for the second transfer roller 58 that transfers, in the second transfer process, toner images, which have been transferred in the first transfer process to the outer surface of the transfer belt 52, onto the medium P. Note that a rotation axis of the transfer belt 52 is the axis of the driving roller 56.

In the present exemplary embodiment, the speed at which the transfer belt 52 rotates (hereinafter referred to as processing speed) during image formation is set to 126 mm/s as an example.

(First Transfer Roller)

The first transfer rollers 54 are disposed in such a manner that the transfer belt 52 is interposed between the first transfer rollers 54 and the photoconductor drums 42, and each of the first transfer rollers 54 is arranged to be offset toward downstream of an imaginary straight line, which passes through the axial center of the corresponding photoconductor drum 42 and which is parallel to the apparatus height direction, in the direction of rotation of the transfer belt 52 (the direction of arrow R3). Thus, the transfer belt 52 is configured to rotate in a state of being wound around the outer circumferential surfaces of the photoconductor drums 42.

A first transfer voltage is applied to the first transfer rollers 54, so that the first transfer rollers 54 transfer, in the first transfer process, the toner images formed on the outer circumferential surfaces of the corresponding photoconductor drums 42Y, 42M, 42C, and 42K onto the outer surface of the transfer belt 52. Note that the first transfer voltage is a voltage that is to be applied to the first transfer rollers 54 in the first transfer process and is set by the controller 24 on the basis of values sensed by a temperature sensor (not illustrated), a humidity sensor (not illustrated), and the like that are disposed in an image forming apparatus body 10A.

(Second Transfer Roller)

The second transfer roller 58 is a roller having an elongated shape. The second transfer roller 58 is pressed by a pressing unit (not illustrated) in such a manner as to define a nip part T2 together with the transfer belt 52 during image formation. A second transfer voltage is applied to the second transfer roller 58 so that the second transfer roller 58 transfers, in the second transfer process, the toner images that have been transferred in the first transfer process to the outer surface of the transfer belt 52 onto the medium P that is transported along a transport path 16C, which will be described later, and that passes through the nip part T2. Note that the second transfer voltage is a voltage that is to be applied to the second transfer roller 58 in the second transfer process and is set like the first transfer voltage by the controller 24.

When the second transfer roller 58 is pressed by the pressing unit and forms the nip part T2 together with the transfer belt 52, the transfer belt 52, which is supported by the driving roller 56, engages with the second transfer roller 58 and is compressed between the second transfer roller 58 and the driving roller 56.

(Cleaning Device)

A cleaning device 100 has a function of removing, by using a scraping member 104, toners, additives, and the like (hereinafter referred to as foreign objects) that have not been transferred in the second transfer process and that remain on the outer surface of the transfer belt 52 from the outer surface of the transfer belt 52 after the toner images, which have been transferred in the first transfer process to the outer surface of the transfer belt 52, have been transferred to the medium P in the second process. Here, the scraping member 104 is an example of a removal member. The cleaning device 100 is disposed along the direction of the tension-applying roller 59 axis in such a manner that the transfer belt 52 is interposed between the cleaning device 100 and the tension-applying roller 59. Note that since the cleaning device 100 is a principal portion of the present exemplary embodiment, the cleaning device 100 will be described later.

(Rest of Configuration)

The transfer unit 50 is configured to be removable from the image forming apparatus body 10A. Thus, as an example, when the transfer belt 52 reaches the end of its service life, that is, when the transfer belt 52 is not able to fulfill its function, the transfer belt 52 is capable of being removed from the image forming apparatus body 10A and replaced.

[Supply Mechanism]

Each of the supply mechanisms 22Y, 22M, 22C, and 22K has a function of supplying a developer to a corresponding one of the developing devices 46Y, 46M, 46C, and 46K. Note that each of the supply mechanisms 22 is configured to supply the developer to the corresponding developing device 46 on the basis of detection results obtained by a corresponding one of the toner-density sensors 60.

[Transport Section]

The transport section 16 has a function of transporting the medium P that is accommodated in the medium-accommodating section 12 to the ejecting section 20, which will be described later. The transport section 16 includes a delivery roller 16A, pairs of transport rollers 16B, a reverse-transport section 16D, and ejection rollers 16E, which will be described later. The delivery roller 16A is configured to send out the medium P, which is accommodated in the medium-accommodating section 12, to downstream of the delivery roller 16A in the direction in which the medium P is to be transported. The pairs of transport rollers 16B are disposed along the transport path 16C along which the medium P, which is sent out by the delivery roller 16A, is to be transported. The pairs of transport rollers 16B are configured to transport the medium P, which is sent out by the delivery roller 16A, to a position (nip part T2) where the driving roller 56 and the second transfer roller 58 face each other.

The transport section 16 includes the reverse-transport section 16D along which the medium P is to be transported with the front and rear surfaces of the medium P reversed to perform image formation on the front and rear surfaces of the medium P. The reverse-transport section 16D is positioned in such a manner that the transport path 16C is interposed between the reverse-transport section 16D and the transfer unit 50 when the image forming apparatus 10 is seen from the front. The medium P having toner images fixed on the front surface thereof is switched back in the reverse-transport section 16D. After that, the reverse-transport section 16D causes the medium P to be transported to the nip part T2 in such a manner that the rear surface of the medium P faces the outer surface of the transfer belt 52.

[Fixing Device]

The fixing device 18 has a function of fixing the toner images, which have been transferred to the medium P in the second transfer process, onto the medium P. The fixing device 18 includes a fixing roller 18A and a pressure roller 18B. The fixing device 18 is disposed downstream of the nip part T2 in the direction in which the medium P is to be transported. The fixing roller 18A is disposed in such a manner as to face one of the front and rear surfaces of the medium P on which toner images have been transferred, and a halogen heater (not illustrated) is disposed in a space enclosed by the inner circumferential surface of the fixing roller 18A. The pressure roller 18B is configured to press, against the fixing roller 18A, the medium P that is transported along the transport path 16C and that passes through a position T3 (see FIG. 1) where the pressure roller 18B and the fixing roller 18A face each other.

[Ejecting Section]

The ejecting section 20 is formed downstream of the fixing device 18 in the direction in which the medium P is to be transported and is formed on a portion of the outer top surface of the image forming apparatus body 10A. The medium P on which toner images have been fixed is to be ejected to the ejecting section 20 by the ejection rollers 16E that are disposed on a portion of the transport path 16C positioned between the fixing device 18 and the ejecting section 20.

<Operation of Image Forming Apparatus>

Operation of the image forming apparatus 10 will now be described with reference to FIG. 1.

The controller 24 causes the image forming apparatus 10 to operate upon receiving an image signal from an external apparatus (e.g., personal computer). The controller 24 converts such an image signal into image data items of yellow (Y), magenta (M), cyan (C), and black (K). Then, each of the image data items of the different colors is output to a corresponding one of the exposure devices 30.

Next, exposure light beams that are emitted from the exposure devices 30 in accordance with the image data items of the corresponding colors are incident on the outer circumferential surfaces of the corresponding photoconductor drums 42 that have been charged by the corresponding charging devices 44. Then, latent images corresponding to the image data items of the different colors are formed on the outer circumferential surfaces of the photoconductor drums 42.

The latent images formed on the outer circumferential surfaces of the photoconductor drums 42 are developed into toner images of the corresponding colors by the developing devices 46.

Then, the toner images of the different colors formed on the outer circumferential surfaces of the photoconductor drums 42 are transferred in a first transfer process onto the outer surface of the transfer belt 52 by the first transfer rollers 54, which face the corresponding photoconductor drums 42.

On the other hand, the medium P is sent out from the medium-accommodating section 12 and transported to the nip part T2 in accordance with the timing at which a portion of the outer surface of the transfer belt 52 to which the toner images have been transferred in the first transfer process reaches the nip part T2 as a result of rotation of the transfer belt 52. Then, the toner images, which have been transferred to the outer surface of the transfer belt 52 in the first process, are transferred in a second process onto the medium P, which is transported to the nip part T2 and which passes through the nip part T2.

Next, the medium P, to which the toner images have been transferred, is transported toward the fixing device 18. Then, the toner images are heated and pressurized by the fixing roller 18A and the pressure roller 18B, which form part of the fixing device 18, in such a manner as to be fixed onto the medium P.

The medium P, to which the toner images have been fixed, is ejected to the ejecting section 20, and the image forming operation is completed.

Note that, in the case of forming images on both the front and rear surfaces of the medium P, the medium P is transported to the reverse-transport unit 16D after the toner images have been fixed to the front surface of the medium P by the fixing device 18. Then, the medium P having the toner images fixed to the front surface thereof is switched back in the reverse-transport section 16D. After that, toner images are transferred in the second transfer process onto the rear surface of the medium P at the nip part T2, and the toner images, which have been transferred in the second transfer process to the rear surface of the medium P, are fixed onto the medium P by the fixing device 18. Finally, the medium P having the toner images fixed to both the front and rear surfaces thereof is ejected to the ejecting section 20, and the image forming operation is completed.

<Configuration of Principal Portion (Cleaning Device 100)>

The cleaning device 100, which is the principal portion of the present exemplary embodiment, will now be described with reference to the drawings.

The cleaning device 100 includes a housing 102, the scraping member 104, constraining mechanisms 106, a sealing portion 108, and an auger 110.

<<Housing>>

The housing 102 has a function of holding the scraping member 104, the constraining mechanisms 106, and the auger 110 and a function of containing foreign objects that are removed from the transfer belt 52 by the scraping member 104.

Figure 2:
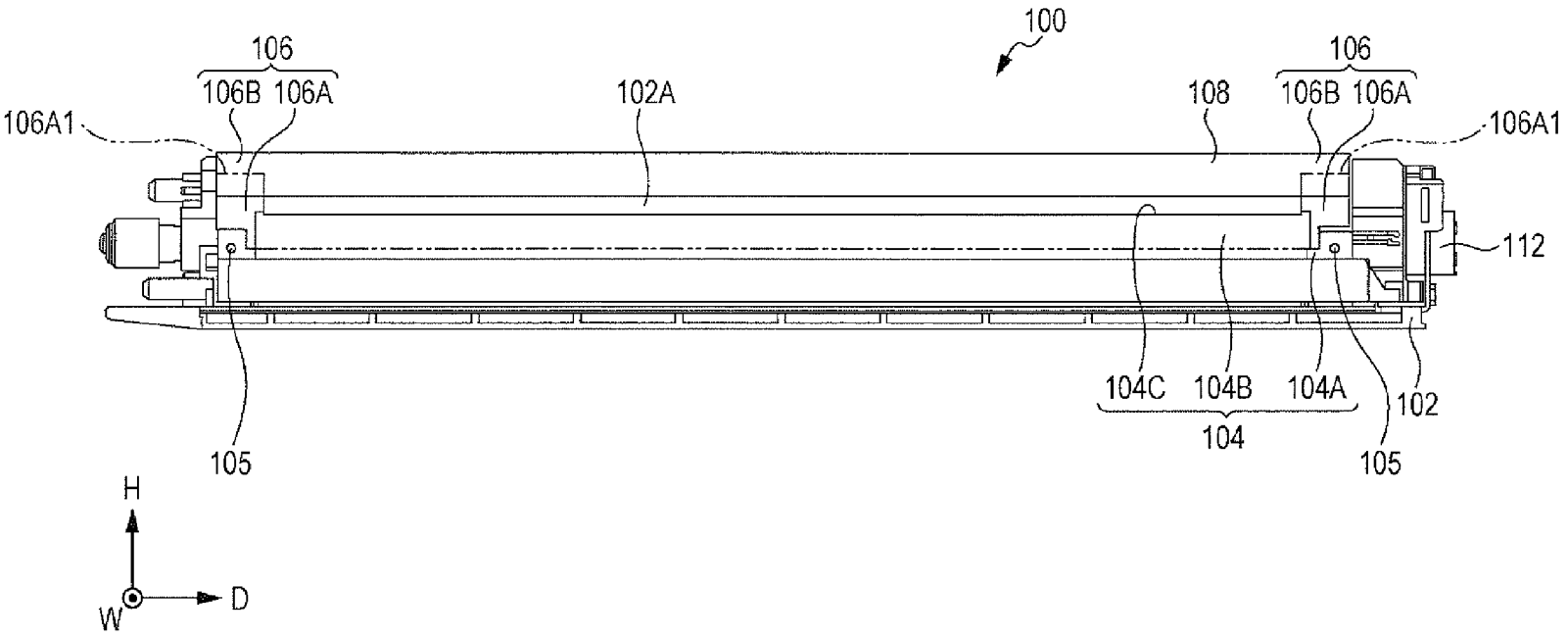
FIG. 2 is a schematic diagram (diagram as seen from an apparatus width direction) of a cleaning device of the exemplary embodiment.

As illustrated in FIG. 1 and FIG. 2, the housing 102 is an elongated box. The housing 102 has an elongated opening 102A that is formed along the longitudinal direction of the housing 102. In addition, the housing 102 is arranged along the apparatus depth direction in such a manner that a portion of the housing 102 in which the opening 102A is formed faces the transfer belt 52. Note that the housing 102 is attached to a side plate (not illustrated) of the transfer unit 50.

<<Scraping Member>>

As illustrated in FIG. 2, the scraping member 104 includes a sheet metal 104A having an elongated shape and a blade 104B having an elongated shape. The sheet metal 104A is fixed to the housing 102 with screws 105. One end portion of the blade 104B in the lateral direction of the blade 104B is bonded to the sheet metal 104A, so that the blade 104B is held by the housing 102. In addition, as illustrated in FIG. 1, the other end portion (edge portion 104C) of the blade 104B in the lateral direction of the blade 104B is in contact with a portion of the transfer belt 52, which is wound around the tension-applying roller 59, in such a manner as to press the transfer belt 52. Here, the scraping member 104 is an example of a removal member.

<<Constraining Mechanism>>

Figure 3:
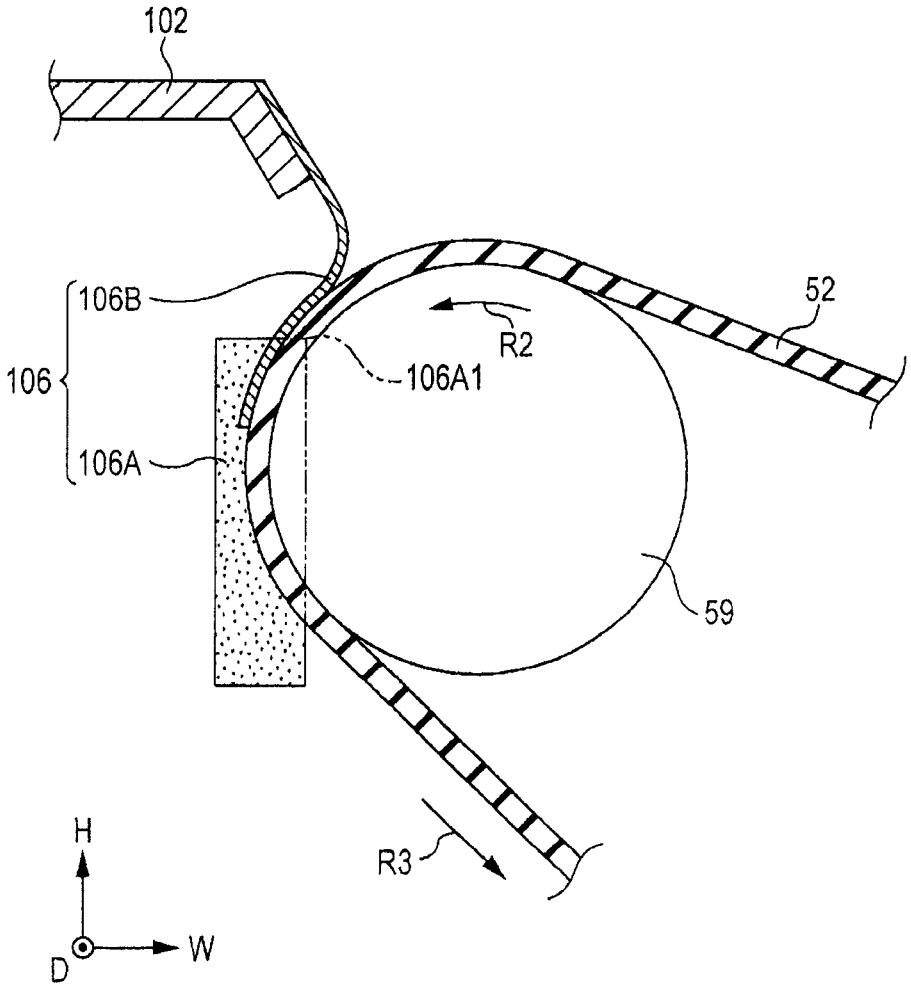
FIG. 3 is a cross-sectional view of the cleaning device of the exemplary embodiment as seen from the front illustrating a state where the cleaning device is in contact with a transfer belt.

As illustrated in FIG. 2 and FIG. 3, each of the constraining mechanisms 106 includes a porous member 106A and a covering portion 106B. Each of the constraining mechanisms 106 has a function of restraining foreign objects that have been removed by the scraping member 104 from moving on the transfer belt 52 in the longitudinal direction of the scraping member 104 by causing the porous member 106A to be in contact with the outer surface of the transfer belt 52. In other words, each of the constraining mechanisms 106 has a function of restraining such foreign objects from moving in the axial direction of the transfer belt 52.

[Porous Member]

Each of the porous members 106A is a member having a rectangular parallelepiped shape. As illustrated in FIG. 2, the porous members 106A are disposed at ends of the scraping member 104 in the longitudinal direction of the scraping member 104 and held by the housing 102. Each of the porous members 106A is formed in a shape that does not make contact with the scraping member 104 in the vicinity of ends (corner portions) of the edge portion 104C of the scraping member 104 in the longitudinal direction of the edge portion 104C when viewed from the apparatus width direction. Note that each of the porous members 106A is bonded to the housing 102 with a double-sided adhesive tape placed on a portion of the porous member 106A and is held by the housing 102.

As illustrated in FIG. 3, a portion of each of the porous members 106A is in contact with the portion of the transfer belt 52 that is wound around the tension-applying roller 59 when viewed from the front. Note that the porous members 106A are pressed by the tension-applying roller 59 with the transfer belt 52 interposed between the porous members 106A and the tension-applying roller 59.

Note that a large number of holes each having an inner diameter larger than the average particle diameter of the toners are formed in a surface of each of the porous members 106A.

[Covering Portion]

As illustrated in FIG. 2, each of the covering portions 106B has a function of suppressing generation of noise by covering an edge portion 106A1 of a corresponding one of the porous members 106A, which are disposed at the ends of the scraping member 104, and the peripheral portion and by being in contact with the transfer belt 52.

In FIG. 3, a portion of one of the porous members 106A that is indicated by a two-dot chain line represents a portion of the porous member 106A when it is assumed that the porous member 106A is not pressed. As illustrated in FIG. 3, the covering portion 106E covers the edge portion (edge portion 106A1) of the porous member 106A and is in contact with the transfer belt 52 as a result of being pressed by the porous member 106A. Here, the edge portion 106A1 of the porous member 106A is an example of an end portion of the porous member 106A located on an upstream side in the direction of rotation of the transfer belt 52.

<<Sealing Portion>>

The sealing portion 108 has a function of restraining foreign objects, which are removed by the scraping member 104, from moving from the opening 102A, which is formed in the housing 102, toward the upstream side in the direction of rotation of the transfer belt 52.

As illustrated in FIG. 2, the sealing portion 108 has an elongated shape. One end of the sealing portion 108 in the lateral direction of the sealing portion 108 is bonded to the housing 102, so that the sealing portion 108 is held by the housing 102. Regarding the other end of the sealing portion 108 in the lateral direction of the sealing portion 108, the entire area of the other end in the longitudinal direction of the sealing portion 108 is in contact with the portion of the transfer belt 52 that is wound around the tension-applying roller 59. Note that, as illustrated in FIG. 1 and FIG. 2, the sealing portion 108 is held by the housing 102 at a position upstream of the scraping member 104 in the direction of rotation of the transfer belt 52.

As illustrated in FIG. 2, the sealing portion 108 is formed integrally with the covering portions 106B that form part of the constraining mechanisms 106, which are disposed at the ends of the scraping member 104. In addition, holes each having an inner diameter larger than the average particle diameter of the toners, such as those formed in the surface of the porous members 106A, are not formed on surfaces of the sealing portion 108 and the covering portions 106B.

<<Auger>>

The auger 110 has a function of transporting foreign objects, which have been removed from the transfer belt 52 by the scraping member 104 and accommodated in the housing 102, from one end to the other end of the housing 102 in the longitudinal direction of the housing 102. As illustrated in FIG. 1, the auger 110 includes a shaft (not illustrated) and a helical member (not illustrated) that is formed over the outer peripheral surface of the shaft. After the foreign objects have been transported to the other end of the housing 102 in the longitudinal direction of the housing 102 by the auger 110, the foreign objects are deposited into a waste box (not illustrated) from a discharge port 112 formed in the housing 102.

[Supplementary Description]

As described above, a portion of the opening 102A of the housing 102 is closed by the porous members 106A positioned at the ends of the opening 102A in the longitudinal direction of the opening 102A, the scraping member 104 positioned at one end of the opening 102A in the lateral direction of the opening 102A, and the sealing portion 108 positioned at the other end of the opening 102A in the lateral direction of the opening 102A. As a result of the porous members 106A, the scraping member 104, and the sealing portion 108 being in contact with the transfer belt 52, the remaining portion of the opening 102A are closed by the transfer belt 52.

Effects of Exemplary Embodiment

The effects of the present exemplary embodiment will be described below with reference to the drawings. First, the mechanism of occurrence of the above-mentioned noise will be described. Next, the effects of the present exemplary embodiment will be described by comparing with comparative examples (Comparative Example 1 and Comparative Example 2). When the components and the like, which have been used in the present exemplary embodiment, are used as in the following description, the reference numerals of the components and the like are used as is.

<<Mechanism of Occurrence of Noise>>

Assume the case where a portion (edge portion 106A1 and peripheral portion) of each of the porous members 106A located on the upstream side in the direction of rotation of the transfer belt 52 comes into contact with the transfer belt 52 that rotates. In this case, the portion of each of the porous members 106A that comes into contact with the transfer belt 52 receives a frictional force from the transfer belt 52 and is compressed toward a downstream side in the direction of rotation of the transfer belt 52. Then, the portion of each of the porous members 106A that has been compressed toward the downstream side in the direction of rotation of the transfer belt 52 returns to its original position on the upstream side in the direction of rotation of the transfer belt 52 as a result of a spring force of the porous member 106A. Due to the relationship between the frictional force received from the transfer belt 52 and the spring force of the porous members 106A, the porous members 106A alternate from being in a state of being compressed with being in a state of being returned to their original positions (the so-called stick-slip phenomenon). As described above, when the porous members 106A come into contact with the transfer belt 52, the porous members 106A vibrate. Thus, it is assumed that noise caused by vibration of the porous members 106A is generated.

Comparison with Comparative Example 1

Next, the present exemplary embodiment will be compared with Comparative Example 1, which will be described below as one of the comparative examples of the present exemplary embodiment.

Figure 4:
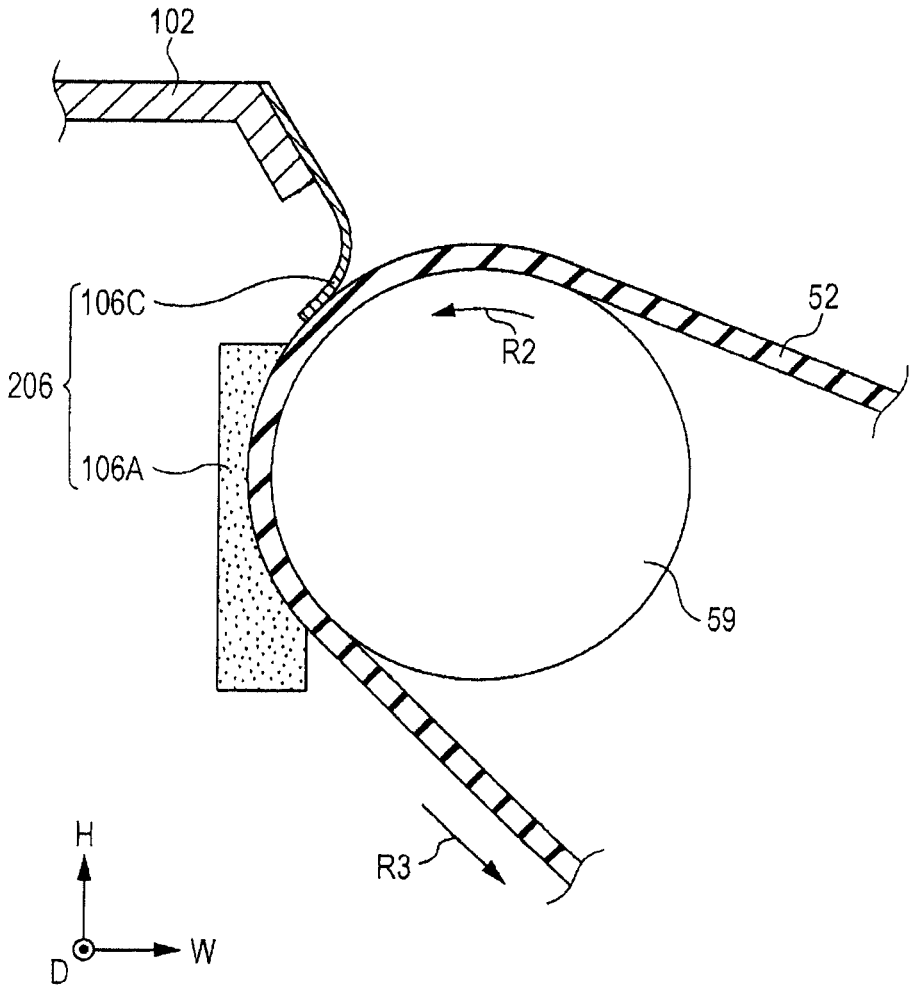
FIG. 4 is a cross-sectional view of a cleaning device of a comparative example (Comparative Example 1) as seen from the front illustrating a state where the cleaning device is in contact with a transfer belt.

As illustrated in FIG. 4, constraining mechanisms 206 of Comparative Example 1 include end portions 106C of a sealing portion. None of the end portions 106C of the sealing portion cover the edge portions 106A1 and the peripheral portions of the porous members 106A. However, the end portions 106C of the sealing portion are in contact with the transfer belt 52. The configurations of the constraining mechanisms 206 of Comparative Example 1, excluding the above, are similar to those of the constraining mechanisms 106 of the present exemplary embodiment.

Since the porous members 106A are positioned at the ends of the opening 102A of the housing 102 in the longitudinal direction of the opening 102A, the constraining mechanisms 206 are capable of restraining foreign objects from moving in the axial direction of the transfer belt 52. However, none of the end portions 106C of the sealing portion cover the edge portions 106A1 and the peripheral portions of the porous member 106A, and thus, noise caused by vibration of the edge portions 106A1 and the peripheral portions that comes into contact with the transfer belt 52, which rotates, is generated.

In contrast, as illustrated in FIG. 3, in the constraining mechanisms 106 of the present exemplary embodiment, the covering portions 106B cover the edge portions 106A1 and the peripheral portions of the corresponding porous members 106A. Thus, the edge portions 106A1 and the peripheral portions of the porous members 106A do not make contact with the transfer belt 52, which rotates.

Therefore, compared with the constraining mechanisms 206 of Comparative Example 1, the constraining mechanisms 106 of the present exemplary embodiment suppress generation of the noise caused as a result of the edge portions 106A1 and the peripheral portions of the porous members 106A being in contact with the transfer belt 52, which rotates.

Comparison with Comparative Example 2

Next, the present exemplary embodiment will be compared with Comparative Example 2, which will be described below as one of the comparative examples of the present exemplary embodiment.

Figure 5:
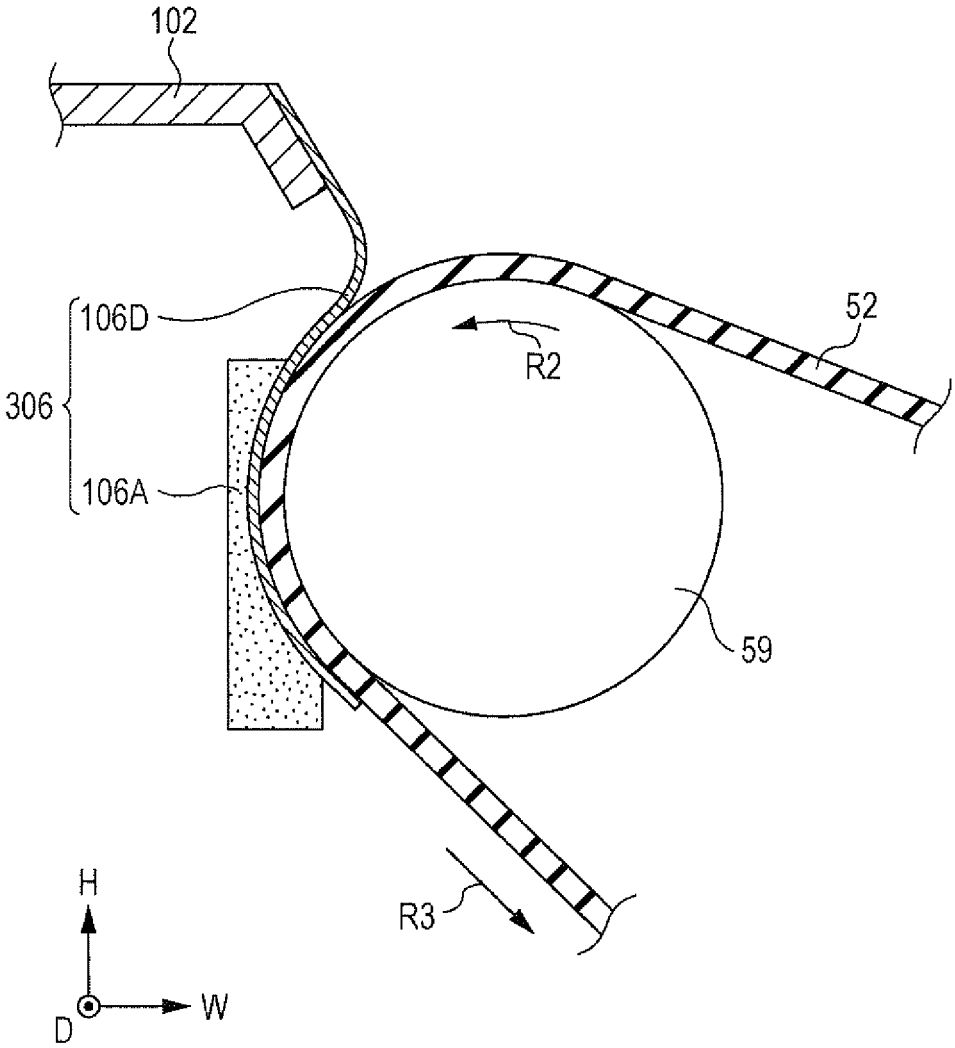
FIG. 5 is a cross-sectional view of a cleaning device of another comparative example (Comparative Example 2) as seen from the front illustrating a state where the cleaning device is in contact with a transfer belt.

As illustrated in FIG. 5, each of constraining mechanisms 306 of Comparative Example 2 includes a covering portion 106D. The covering portions 106D cover the entire porous members 106A. Thus, the porous members 106A are not configured to make contact with the transfer belt 52. The configurations of the constraining mechanisms 306 of Comparative Example 2, excluding the above, are similar to those of the constraining mechanisms 106 of the present exemplary embodiment.

In the constraining mechanisms 306, since the covering portions 106D cover the entire porous members 106A, the porous members 106A do not make contact with the transfer belt 52, which rotates. Thus, in the case where the constraining mechanisms 306 are employed, noise caused by vibration of the edge portions 106A1 and the peripheral portions that come into contact with the transfer belt 52, which rotates, will not be generated. However, in the constraining mechanisms 306, the porous members 106A are not in contact with the transfer belt 52, and the covering portions 106D are in contact with the transfer belt 52. Thus, the constraining mechanisms 306 are not able to catch foreign objects by using the porous members 106A, and as a result, the foreign objects are likely to move in the axial direction of the transfer belt 52.

In contrast, in the constraining mechanisms 106 of the present exemplary embodiment, portions of the porous members 106A, excluding portions of the porous members 106A that are covered by the covering portions 106B, are in contact with the transfer belt 52.

Accordingly, compared with the constraining mechanisms 206 of Comparative Example 2, the constraining mechanisms 106 of the present exemplary embodiment restrain foreign objects from moving in the axial direction of the transfer belt 52.

As described above, in the case where the constraining mechanisms 106 of the present exemplary embodiment are employed, foreign objects are restrained from moving in the axial direction of the transfer belt 52, and the generation of noise is suppressed compared with the case where the constraining mechanisms 206 of Comparative Example 1 or the constraining mechanisms 306 of Comparative Example 2 are employed.

The configuration of a cleaning device that includes the constraining mechanisms 206 of Comparative Example 1 or the constraining mechanisms 306 of Comparative Example 2 is similar to that of the cleaning device 100 of the present exemplary embodiment, except with regard to the differences between the configurations of the constraining mechanisms. In such a case, compared with the cleaning device that includes the constraining mechanisms 206 of Comparative Example 1 or the constraining mechanisms 306 of Comparative Example 2, the cleaning device 100 of the present exemplary embodiment suppresses the generation of noise while removing foreign objects adhered to the transfer belt 52.

In the present exemplary embodiment, the sealing portion 108 and the covering portions 106B are integrally formed in such a manner as to have both the function of the sealing portion 108, which is to restrain foreign objects from moving toward the upstream side in the direction of rotation of the transfer belt 52, and the function of the covering portions 106B, which is to suppress the generation of noise. Note that a cleaning device that includes the sealing portion 108 and the covering portions 106B as different members is within the technical scope of the present invention.

Along with this, compared with a transfer unit that includes the constraining mechanisms 206 of Comparative Example 1 or the constraining mechanisms 306 of Comparative Example 2, the transfer unit 50 of the present exemplary embodiment suppresses the generation of noise while removing foreign objects adhered to the transfer belt 52.

Along with this, compared with an image forming apparatus that includes the constraining mechanisms 206 of Comparative Example 1 or the constraining mechanisms 306 of Comparative Example 2, the image forming apparatus 10 of the present exemplary embodiment suppresses the generation of noise during image formation.

Although the specific exemplary embodiment of the present invention has been described above in detail, the present invention is not limited to the above-described exemplary embodiment, and the present invention may employ other exemplary embodiments within the scope of the present invention.

For example, although the case where the constraining mechanisms 106 and the cleaning device 100 of the present exemplary embodiment comes into contact with the outer surface of the transfer belt 52, which serves as a rotating body, and remove foreign objects adhered to the outer surface of the transfer belt 52, the rotating body is not limited to the transfer belt 52 as long as the constraining mechanisms 106 and the cleaning device 100 are configured to remove foreign objects adhered to the outer surface of the rotating body. For example, the cleaning device 100 may be used instead of each of the constraining mechanisms included in the removal devices 48 for the photoconductor drums 42 or each of the removal devices 48. Note that, in this case, each of the photoconductor drums 42 is an example of an image carrier, each of the removal devices 48 is an example of a cleaning device, each of the blades 48A is an example of a removal member, and the medium P is an example of a transfer body. In addition, in this case, each of the image forming units 40 is an example of an image carrier unit.

Although each of the image forming units 40 has been described as an example of an image carrier unit, each of the image forming units 40 may include at least one of the photoconductor drums 42, each of which serves as a rotating body, and one of the removal devices 48, each of which is an example of a cleaning device.

In addition, the case where the constraining mechanisms 106 and the cleaning device 100 of the present exemplary embodiment are included in the image forming apparatus 10 of a so-called intermediate transfer type that includes the transfer unit 50. However, the constraining mechanisms 106 and the cleaning device 100 may be included in an image forming apparatus that directly transfers toner images, which are formed on the photoconductor drums 42, onto the medium P as long as the image forming apparatus includes a medium transport belt or a photoconductor drum, which serves as a rotating body. For example, the constraining mechanisms 106 and the cleaning device 100 may be used as a cleaning device for a medium transport belt or a photoconductor drum and a constraining mechanism that forms the cleaning device.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A constraining mechanism comprising:

a porous member that is in contact with a rotating body, which rotates about a rotation axis, and restrains foreign objects from moving in an axial direction of the rotating body; and a covering portion that covers a portion of the porous member including a full width, in an axial direction of the rotating body, of an upper end portion of the porous member, the upper end portion being disposed on an upstream side of the porous member in a direction of rotation of the rotating body, the covering portion is in contact with the rotating body as a result of being pressed by the porous member, and at least a portion of the covering portion being located upper from the upstream end portion of the porous member in a direction of rotation of the rotating body.

2. A cleaning device comprising:

a removal member that is in contact with a rotating body and removes foreign objects adhered to the rotating body;

at least one constraining mechanism according to claim 1 that is disposed at an end of the removal member.

3. The cleaning device according to claim 2, further comprising:

a sealing portion that is disposed on a portion of the removal member and that seals the portion of the removal member, at least a portion of the sealing portion being located upstream from the removal member in a direction of rotation of the rotating body, wherein the at least one constraining mechanism includes a plurality of constraining mechanisms, wherein the plurality of constraining mechanisms are disposed at ends of the removal member, and wherein the sealing portion is formed integrally with covering portions, each of which forms part of a corresponding one of the constraining mechanisms.

4. An image carrier unit comprising:

an image carrier that holds a toner image on an outer peripheral surface of the image carrier and that serves as a second rotating body; and the cleaning device according to claim 2.

5. An image carrier unit comprising:

an image carrier that holds a toner image on an outer peripheral surface of the image carrier and that serves as a second rotating body; and the cleaning device according to claim 3.

6. An image forming apparatus comprising:

an image carrier that holds a toner image;

a transfer body that serves as a rotating body and onto which the toner image, which has been held by the image carrier, is transferred;

the cleaning device according to claim 2; and a fixing device that fixes the toner image, which has been transferred to a medium from the transfer body, onto the medium.

7. An image forming apparatus comprising:

an image carrier that holds a toner image;

a transfer body that serves as a rotating body and onto which the toner image, which has been held by the image carrier, is transferred;

the cleaning device according to claim 3; and a fixing device that fixes the toner image, which has been transferred to a medium from the transfer body, onto the medium.

8. An image forming apparatus comprising:

an image carrier that holds a toner image and that serves as a second rotating body;

the cleaning device according to claim 2;

a transfer body onto which the toner image, which has been held by the image carrier, is transferred; and a fixing device that fixes the toner image, which has been transferred to a medium from the transfer body, onto the medium.

9. An image forming apparatus comprising:

an image carrier that holds a toner image and that serves as a second rotating body;

the cleaning device according to claim 3;

a transfer body onto which the toner image, which has been held by the image carrier, is transferred; and a fixing device that fixes the toner image, which has been transferred to a medium from the transfer body, onto the medium.

10. The image forming apparatus according to claim 6, further comprising:

a transfer belt; and a plurality of rollers, wherein the porous member is in contact with the transfer belt due to being pressed by one of the rollers.

11. The image forming apparatus according to claim 7, further comprising:

a transfer belt; and a plurality of rollers, wherein the porous member is in contact with the transfer belt due to being pressed by one of the rollers.

12. The image forming apparatus according to claim 8, further comprising:

a transfer belt; and a plurality of rollers, wherein the porous member is in contact with the transfer belt due to being pressed by one of the rollers.

13. The image forming apparatus according to claim 9, further comprising:

a transfer belt; and a plurality of rollers, wherein the porous member is in contact with the transfer belt due to being pressed by one of the rollers.

14. The constraining mechanism according to claim 1, wherein at least a portion of the porous member, excluding a portion of the porous member that is covered by the covering portion, is in contact with the rotating body.

* * * * *